United States Patent [19]

Link

[11] 4,120,457

[45] Oct. 17, 1978

[54] PULVERIZER

[75] Inventor: Donald F. Link, Huntsville, Ala.

[73] Assignee: Recovery Systems, Inc., Charleston, S.C.

[21] Appl. No.: 845,362

[22] Filed: Oct. 25, 1977

Related U.S. Application Data

[63] Continuation-in-part of Ser. No. 766,132, Feb. 7, 1977, Pat. No. 4,074,868.

[51] Int. Cl.[2] ..... B02C 13/16

[52] U.S. Cl. ..... 241/46 R; 241/46.08; 241/101.2; 241/261

[58] Field of Search ..... 241/46 R, 46 A, 46 B, 241/46.02, 46.08, 46.11, 46.17, 101.2, 101.5, 152 A, 152 R, 157, 162, 188 R, 180, 248, 257 R, 257 G, 261

[56] References Cited

U.S. PATENT DOCUMENTS

| | | | |
|---|---|---|---|
| 1,062,481 | 5/1913 | Lane | 241/261 |
| 2,063,996 | 12/1936 | Geruais | 241/257 R |
| 2,869,795 | 1/1959 | Higer | 241/46 B |
| 3,323,728 | 6/1967 | Shepherd | 241/46 R |
| 4,074,868 | 2/1978 | Link | 241/46 R |

*Primary Examiner*—Granville Y. Custer, Jr.
*Attorney, Agent, or Firm*—C. A. Phillips

[57] ABSTRACT

A device for pulverizing waste food and other similar materials employing a pivotally mounted hammer on a horizontally rotating plate which operates in relation to a fixed cylindrical surface of variable height lands and grooves, and thereafter, the food is passed between horizontally arranged and relatively rotating sets of lands and grooves.

4 Claims, 4 Drawing Figures

PULVERIZER

This application is a continuation-in-part of an application by the same applicant entitled, "Food Processing System," bearing Ser. No. 766,132, filed Feb. 7, 1977, now U.S. Pat. No. 4,074,868, issued Feb. 21, 1978.

BACKGROUND OF THE INVENTION

This invention relates to the conversion of vegetable and animal matter into an emulsion, and more particularly to a system which includes improved means for pulverizing and emulsifying the source material.

GENERAL DESCRIPTION OF THE PRIOR ART

A principal problem in the construction of a compact and economical system for the conversion of waste food, including bones and tough fibers, to dried animal feed is that of breaking down the food into sufficiently small particles and to accomplish this economically. Heretofore, it has been found that the particle size should be reduced down to a maximum cross section of approximately 0.03 inch in order to achieve consistency in drying and sterilization. The applicant is unaware of the existence of any single apparatus for accomplishing this, it having been the known practice of utilizing staged breakers, cutters, and even then the results were not entirely satisfactory. Particularly, it has been most difficult to obtain uniformity in particle size from a variety of waste food sources.

Accordingly, it is an object of this invention to provide an improved animal and vegetable material pulverizer wherein a smaller and more uniform pulverization is achieved.

SUMMARY OF THE INVENTION

In accordance with this invention, pulverization is achieved by a device having two basic parts, a rotor and a stator. The stator has a series of vertically and circumferentially spaced lands on an inner surface of a tubular portion of it and a series of radially and circumferentially spaced lands on the underside of a plate portion which extends radially outwardly and horizontally from a bottom end of the tubular portion. The rotor member, generally in the form of a rotating plate, includes a pivotally attached hammer which operates between variable height lands on the tubular portion of the stator and radially and circumferentially spaced lands which rotate within the horizontally arranged lands of the stator.

DETAILED DESCRIPTION OF THE DRAWINGS

Figures 1, 2, 3, 4:
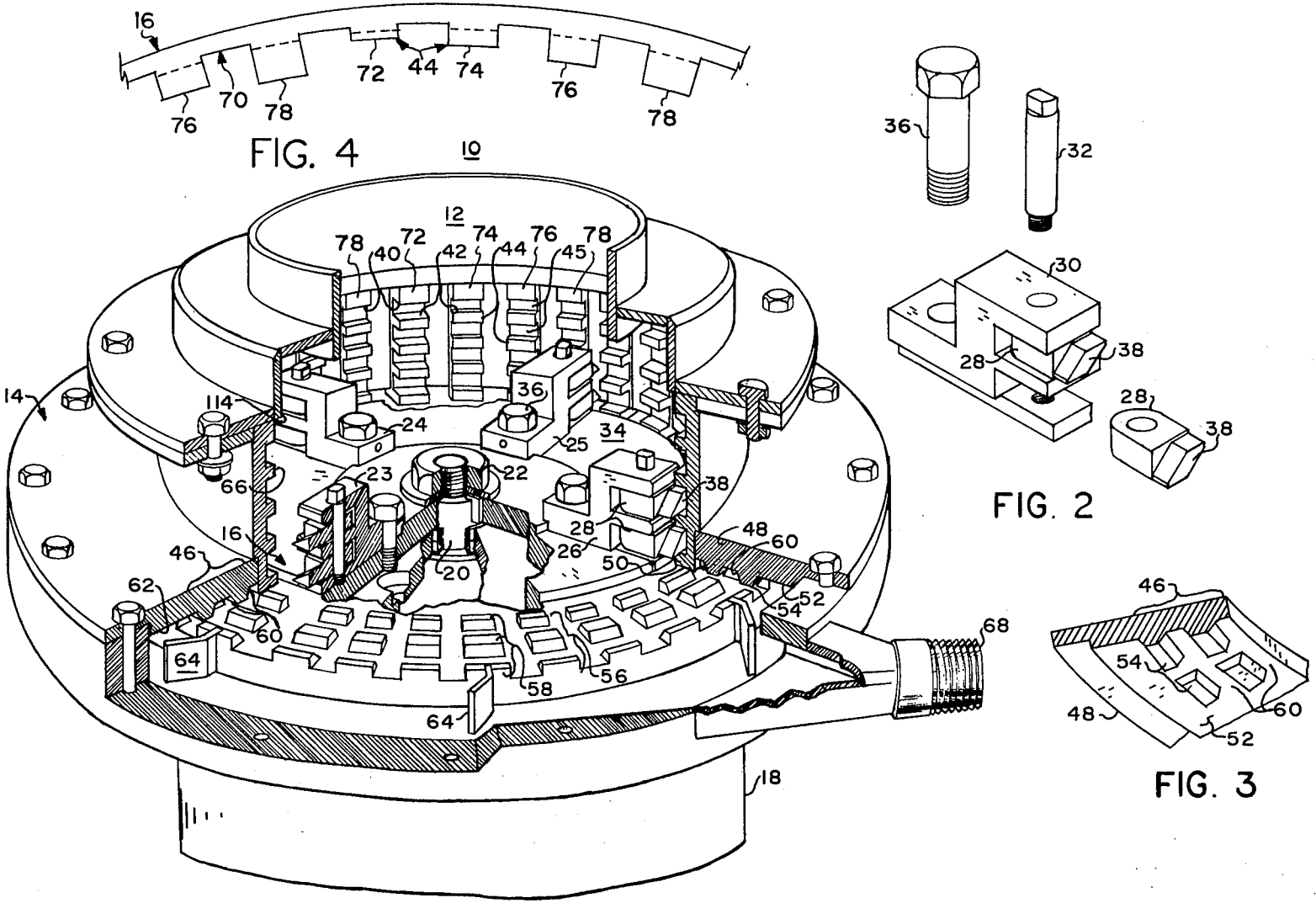
FIG. 1 is a pictorial view of a pulverizer as contemplated by this invention.
FIG. 2 is an exploded view of the construction of a pivotal hammer employed by the pulverizer.
FIG. 3 is a partial view of the underside of an annular plate region of the stator of the pulverizer shown in FIG. 1.
FIG. 4 is a plan view of a portion of the stator of the pulverizer shown in FIG. 1.

Referring to the drawings, pulverizer 10 includes a throat region 12 through which waste food is supplied. Pulverizer 10 basically consists of stator 14 and rotor 16, the latter being driven by motor 18 via shaft 20, which is attached by means of nut 22. Hammer assemblies 23, 24, 25, and 26, spaced 90° apart, each include first and second hammers 28 held on frame member 30 by pin 32. Each of these assemblies is attached to a generally flat plate central region 34 of rotor 16 by bolt 36. Hammers 28 have diagonally cut sides 38 with a height dimension which fits with a 0.020 to 0.030 inch clearance between upper and lower surfaces 40 and 42 of mating circular lands 44 in a tubular portion of stator 14. Four grooves 45, formed between the lands, are shown, as well as only two sets of mating hammers; but it is to be appreciated that additional hammers may be added above the two shown to operate in the remaining grooves 45 of stator 14. An annular extension 46 of stator 14 is formed by a generally horizontal stator plate 48, extending radially outward from the lower edge 50 of the tubular portion of stator 14. The lower surface 52 of this extension consists of radially and circumferentially spaced lands 54 which form a generally peripheral portion of stator 14. An outer annular portion 56 of rotor 16 has a like configured, but a complementary set of lands 58 which rotate within grooves 60 formed by the lands 54 of stator 14. Exterior of the outer edge of rotor plate 16 and stator 14 is an annular cavity 62 in which vanes 64, attached to rotor plate 16, operate and form a pump which picks up pulverized particles. Thus, the waste food, progressively pulverized, flows down through tubular cavity 66 of the device and out between the horizontally mated lands and grooves 58 and 60, respectively, where it is pumped out through exit opening 68.

FIG. 4 shows a plan view of a portion of rotor 16. It particularly illustrates, with FIG. 1, the different surface levels, radially measured, of the lands and grooves. Thus, grooves 45, vertically arranged in otherwise columns of lands 44, are less deep, radially measured, than column of grooves 70. Additionally, the height of successive columns of lands, radially measured, are graduated as shown by the difference in height between grooves 70 and 45 and land columns 72, 74, 76, and 78. The progressive change in radius of these six surfaces is approximately 0.0625 inch. The pattern of variable heights of the lands is repeated around the periphery of rotor 16.

OPERATION

Moist waste food or other like material is fed by gravity into throat 12 of pulverizer 10. This causes it to be initially deposited on rotor plate 16 which, by centrifugal force, moves the material laterally to inner circular wall 114, forming with rotor plate 16 a grinding bowl. The radially extending hammers 28, extending by centrifugal force, force the material between lands 44 of wall 114, causing the material to be reduced to small particles. The material is then forced downward and along the forward (considering direction of movement) inclined plane 38 of hammers 28. This motion is continuous until the waste food is essentially liquified and forced downward to the radial space formed between mating lands 58 of rotor 16 and lands 54 of stator 14. The material is then forced outward between these lands and further reduced in particle size. It then reaches vane pump 62 where the pump vanes 64 force the material out through outlet 68 to an appropriate storage container or to other equipment for, for example, dehydration. In addition to the particular effectiveness of hammer 38 with its inclined side surfaces, the variable heights of lands and grooves as shown in FIG. 4 prevents mere shaving and assist in achieving a rapid and fine pulverization of material.

I claim:

1. A pulverizer comprising:

a stator member comprising:

a vertically oriented, generally round, cylindrical, interior surface, the top end of which forms an input opening to said pulverizer, and said surface having a plurality of vertical and circumferentially horizontal spaced rows and columns of lands and grooves, and wherein grooves lying in one column vary in depth with respect to grooves lying in horizontally adjacent grooves;

a first circular plate extending around and radially outward from a lower end of said interior surface, and having a lower, generally horizontal, surface comprising a plurality of concentrically and circumferentially spaced lands;

a motor;

a rotor member driven from said motor comprising:

a second circular plate positioned for rotation about a vertical axis concentric with said cylindrical surface of said stator member, and at least one hammer rotably attached to said second circular plate for horizontal pivotal movement about a vertical axis, said hammer being positioned to pass within a groove with lands of said cylindrical surface of said stator member, and a plurality of concentrically and circumferentially spaced lands and grooves in said second circular plate and positioned for mating rotation between said lands of said first circular plate of said stator member; and collection means including an annular passageway generally outboard of said circular plates for collecting pulverized material passing outboard and between said circular plates and for providing said material as a confined output flow.

2. A pulverizer as set forth in claim 1 wherein lands lying in one column differ in height, radially measured, from lands lying in an adjacent column, wherein said difference in height is progressive around the periphery of said interior surface for at least three succeeding columns and is repeatable in such progression around the periphery of said interior surface.

3. A pulverizer as set forth in claim 2 wherein grooves between lands of a column of lands are of lesser depth, radially measured, than grooves lying in adjacent columns of grooves.

4. A pulverizer as set forth in claim 1 wherein a leading side surface of an end region of a said hammer is inclined, rises at an angle of less than 90° with respect to a vertical line, a vertical line being a line through the bottom of the forward edge of said hammer which is parallel with said vertically oriented interior surface of said stator, whereby material being pulverized is forced downward by being struck by said leading side of said hammer.

* * * * *